US007600987B2

(12) United States Patent
Seto et al.

(10) Patent No.: US 7,600,987 B2
(45) Date of Patent: Oct. 13, 2009

(54) PUMP

(75) Inventors: Takeshi Seto, Chofu (JP); Kunihiko Takagi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 333 days.

(21) Appl. No.: 11/279,844

(22) Filed: Apr. 14, 2006

(65) Prior Publication Data

US 2006/0245947 A1 Nov. 2, 2006

(30) Foreign Application Priority Data

Apr. 14, 2005 (JP) ..... 2005-116566
Mar. 8, 2006 (JP) ..... 2006-062734

(51) Int. Cl.
*F04B 17/00* (2006.01)

(52) U.S. Cl. ..... 417/413.2; 417/413.1; 417/542

(58) Field of Classification Search ..... 417/413.2, 417/413.1, 542, 557, 410.1, 274, 559, 565, 417/566, 571; 137/859, 855, 512.4; 96/208, 96/209, 216, 204
See application file for complete search history.

(56) References Cited

U.S. PATENT DOCUMENTS 4,662,908 A * 5/1987 Suzuki et al. ..... 96/211
4,690,762 A * 9/1987 Katsura ..... 96/212
4,895,500 A * 1/1990 Hok et al. ..... 417/566
5,240,477 A * 8/1993 Yamaga et al. ..... 95/261
5,259,737 A * 11/1993 Kamisuki et al. ..... 417/322
6,240,962 B1 * 6/2001 Tai et al. ..... 137/859
6,623,256 B2 9/2003 Takagi et al.
6,749,407 B2 * 6/2004 Xie et al. ..... 417/413.2

FOREIGN PATENT DOCUMENTS

CN A-1372078 10/2002
JP 09151838 A * 6/1997
JP B2 2975105 9/1999
JP A 11-333207 12/1999
JP A 2005-305235 11/2005

OTHER PUBLICATIONS

"The High Power Micro Pump Using Interial Effect of Fluid"; Japan Mechanical Society Journal 2003; vol. 106, No. 1019; p. 823 with translation.

* cited by examiner

*Primary Examiner*—Devon C Kramer
*Assistant Examiner*—Amene S Bayou
(74) *Attorney, Agent, or Firm*—Oliff & Berridge, PLC

(57) ABSTRACT

A pump includes: a pump chamber for which a capacity is changeable; an inlet channel which allows a working fluid to flow into the pump chamber; an inlet side fluid resistance element disposed between the pump chamber and the inlet channel; an outlet channel which allows the working fluid to flow out of the pump chamber; and a pipeline element formed inside the outlet channel, wherein a rotational flow generation structure, which generates a rotational flow of the working fluid, is provided in the pump chamber, and wherein the outlet channel is located adjacent to the rotational center of the rotational flow.

17 Claims, 12 Drawing Sheets

PUMP

BACKGROUND

1. Technical Field

The present invention relates to a pump which carries out a movement of a working fluid by changing a capacity inside a pump chamber by means of a piston, a diaphragm or the like, and in particular to a compact, high-output pump.

2. Related Art

Until now, with a configuration of replacing a check valve of an outlet channel with a channel structure having a large inertance value, using an inertia effect of a fluid, a highly-reliable high-output pump with a large discharge flow volume corresponding to a high load pressure has been developed by the inventors of the invention. (Refer to Nonpatent Document 1: "A high-output micro pump using an inertia effect of a fluid" Japan Mechanical Society Journal 2003.10 VOL. 106 No. 1019 (Page 823, FIGS. 1 to 5)).

Also, in a fluid system which has as a fluid drive source a pump, such as a centrifugal pump, having a liquid as a working fluid, whose pumping capability deteriorates in the event that a gas accumulates inside the pump, it is often the case that a device is provided whereby a rotational flow is generated inside a channel, hereby eliminating air bubbles in the working fluid. (For example, refer to Patent Document 1: JP-A-11-333207 (Page 4, FIG. 1))

Also, a blood pump unit has been known wherein a rotational flow is generated inside the pump in order to prevent a coagulation of blood due to an accumulation of the blood inside the pump. (Refer to Patent Document 2: Japanese Patent No. 2975105 (Page 6. FIGS. 12 and 13)).

In the case of a configuration in Nonpatent Document 1, a problem has existed wherein, in the event that air bubbles enter the pump, even though the pump capacity is changed, the pressure inside the pump chamber does not rise sufficiently due to the effect of the air bubbles, the performance deteriorates and, in the event that more than a certain amount of air bubbles enter the pump, discharge of the fluid becomes impossible.

In the case of the kind of air bubble removal device in Patent Document 1, although it is possible to carry out removal of the air bubbles in the working fluid by installing the device in a channel inside a circulatory liquid cooling device of a closed electronic instrument such as a cooling system, thereby reducing the inflow of air bubbles to the pump chamber, there has been no benefit with respect to air bubbles which have entered the pump chamber.

The pump in Patent document 2 has been designed to prevent the coagulation of blood caused by accumulation, and has not generated a rotational flow sufficient for the elimination of air bubbles.

SUMMARY

An advantage of some aspects of the invention is to provide a pump which can deal with a high load pressure, has a large discharge flow volume, and can regain a discharge capability even in the event of air bubbles entering the pump chamber.

A pump according to an aspect of the invention comprises: a pump chamber for which a capacity is changeable; an inlet channel which allows a working fluid to flow into the pump chamber; an inlet side fluid resistance element disposed between the pump chamber and the inlet channel; an outlet channel which allows the working fluid to flow out of the pump chamber; and a pipeline element formed inside the outlet channel, a synthetic inertance value of the inlet channel being smaller than a synthetic inertance value of the outlet channel. In the pump, as well as a rotational flow generation structure being provided in the pump chamber, the outlet channel is disposed at the rotational axis of the approximately rotor configuration of the pump chamber.

According to the aforementioned configuration, as it is possible to utilize a fluid inertia force caused by a kinetic energy accumulated in the outlet channel, the pump becomes a high-output one with a large discharge flow volume which can deal with a high load pressure. Furthermore, as a rotational flow is generated in the pump chamber, the air bubbles which flow into the pump chamber are collected by a centrifugal force in the vicinity of the center of the approximately circularly configured pump chamber, whereby they are swiftly discharged through the outlet channel, which is roughly in the center of the pump chamber. As a result, there is no question of the air bubbles in the pump chamber increasing, meaning that it is possible to prevent a deterioration in the performance of the pump.

The aspect of the invention is not limited to a pump in which the synthetic inertance value of the inlet channel is smaller than the synthetic inertance value of the outlet channel. For example, it can also be applied to a pump in which the synthetic inertance value of the inlet channel is larger than the synthetic inertance value of the outlet channel, and the outlet channel is also equipped with a fluid resistance element.

Also, according to the aspect of the invention, it is not absolutely necessary that the rotational flow generation structure is installed in the pump chamber.

Also, according to the aspect of the invention, it is not absolutely necessary that the pump chamber is of an approximately rotor configuration, and that the outlet channel is disposed in alignment with the rotational axis of the approximately rotor configuration of the pump chamber. It is also acceptable that it is disposed adjacent to the rotational center of the rotational flow of the working fluid.

That is, it is sufficient that the pump according to the aspect of the invention comprises a pump chamber for which a capacity is changeable; an inlet channel which allows a working fluid to flow into the pump chamber; an inlet side fluid resistance element disposed between the pump chamber and the inlet channel; an outlet channel which allows the working fluid to flow out of the pump chamber; and a pipeline element formed inside the outlet channel, wherein a rotational flow generation structure, which generates a rotational flow of the working fluid, is provided in the pump chamber, and wherein the outlet channel is located adjacent to the rotational center of the rotational flow.

In accordance with the pump according to the aspect of the invention having this kind of configuration, as a rotational flow is generated in the pump chamber by a rotational flow generator, the air bubbles which flow into the pump chamber are collected by a centrifugal force in the vicinity of the center of the pump chamber (the rotational center), whereby they are swiftly discharged through the outlet channel, which is disposed adjacent to the rotational center of the rotational flow. As a result, there is no question of the air bubbles in the pump chamber increasing, meaning that it is possible to prevent a deterioration in the performance of the pump.

Also, according to an aspect of the invention, the rotational flow generation structure is the inlet side fluid resistance element.

According to the aforementioned configuration, it is possible to generate a rotational flow by the working fluid passing the inlet side fluid resistance element. Consequently, in the pump according to the aspect of the invention, in which a time for which the working fluid is flowing inside the pump chamber is longer in comparison with a time for which the inflow is stopped, it is possible to more effectively generate a high-speed rotational flow by a fluid inertia force caused by a kinetic energy accumulated in the outlet channel.

Also, a pump according to an aspect of the invention includes a plurality of the inlet side fluid resistance elements.

According to the aforementioned configuration, as well as more smoothly generating a rotational flow, it is possible to reduce a suction resistance, thereby increasing the flow volume.

Also, according to an aspect of the invention, the pump chamber having an approximately rotor configuration, the inlet side fluid resistance element is a check valve which opens onto one circumferential direction of the approximately rotor configuration of the pump chamber.

According to the aforementioned configuration, it is possible to generate a rotational flow with a simple structure.

Also, according to an aspect of the invention, the plurality of check valves is formed from a single member.

According to the aforementioned configuration, it is possible to manufacture the plurality of check valves at a low cost, and to increase ease of assembly.

Also, according to an aspect of the invention, a flow restriction section, which restricts a flow direction of the working fluid, is provided in the check valve or in a part of the pump chamber with which the check valve is in contact.

According to the aforementioned configuration, as it is possible to restrict the flow direction of the working fluid in the rotational flow direction, the rotational flow of the working fluid can be easily and strongly formed.

Also, according to an aspect of the invention, the flow restriction section being a bent portion formed in the check valve, a storage groove, which stores the bent portion, is formed in a part of the pump chamber with which the check valve is in contact.

According to the aforementioned configuration, as well as enabling the restriction of the flow direction of the working fluid with a simple structure, as it is possible to store the bent portion in the storage groove, the check valve can be caused to function reliably.

Furthermore, according to an aspect of the invention, the rotational flow generation structure is such that the channel from the inlet side resistance element to the pump chamber is an inclined channel which inclines in a circumferential direction of the approximately circular configuration of the pump chamber. By this means, the rotational flow generation structure no longer depends on the fluid resistance element, thus enabling the use of a fluid resistance element of an optimum structure for a variety of working fluids.

Also, according to an aspect of the invention, the rotational flow generation structure is an inclined channel formed by inclining the channel, from the inlet side resistance element to the pump chamber, in a circumferential direction of the approximately rotor configuration of the pump chamber.

Also, a pump according to an aspect of the invention includes a plurality of the inclined channels.

According to the aforementioned configuration, as well as more smoothly generating a rotational flow, it is possible to reduce a suction resistance, thereby increasing the flow volume.

According to the aspect of the invention, it is not absolutely necessary that the channel used as the rotational flow generation structure is an inclined channel. For example, it is also acceptable that the channel is horizontal.

That is, it is sufficient that the rotational flow generation structure is a channel facing in the circumferential direction of the approximately rotor configuration of the pump chamber.

According to this kind of configuration, as the working fluid flows in the circumferential direction of the approximately rotor configuration, it is possible to generate the rotational flow of the working fluid.

Also, according to an aspect of the invention, the channels are located so as to be connected to a side wall of the pump chamber.

According to the aforementioned configuration, the working fluid flows along the side wall of the pump chamber. As a result, it is possible to generate a fast-flowing rotational flow in the vicinity of the side wall of the pump chamber, where the air bubbles are most likely to accumulate, thereby enabling a more reliable elimination of the air bubbles.

Furthermore, a pump according to an aspect of the invention includes a flow speed increase section which accelerates a flow speed of the working fluid inside the pump chamber.

According to the aforementioned configuration, the flow speed of the working fluid inside the pump chamber is accelerated by the flow speed increase section. As a result, it is possible to generate a stronger rotational flow in the pump chamber, thus enabling a more reliable elimination of the air bubbles.

Furthermore, a pump according to an aspect of the invention comprises: an approximately rotor-configured pump chamber for which a capacity is changeable; an inlet channel which allows a working fluid to flow into the pump chamber; an inlet side fluid resistance element disposed between the pump chamber and the inlet channel; an outlet channel which allows the working fluid to flow out of the pump chamber; and a pipeline element formed inside the outlet channel, a synthetic inertance value of the inlet channel being smaller than a synthetic inertance value of the outlet channel, wherein a buffer chamber, which reduces the inertance of a fluid, is annularly formed in a periphery of the outlet channel.

According to the aforementioned configuration, as the buffer chamber can be formed in the vicinity of the inlet side fluid resistance element, the synthetic inertance of the inlet channel decreases, enabling an effective generation of an inertia effect and an even higher output.

Furthermore, a pump according to an aspect of the invention comprises: an approximately rotor-configured pump chamber for which a capacity is changeable; an inlet channel which allows a working fluid to flow into the pump chamber; an inlet side fluid resistance element disposed between the pump chamber and the inlet channel; an outlet channel which allows the working fluid to flow out of the pump chamber; and a pipeline element formed inside the outlet channel, a synthetic inertance value of the inlet channel being smaller than a synthetic inertance value of the outlet channel, wherein the side wall of the pump chamber is formed of an annular member.

According to the aforementioned configuration, a change in a volume etc. of a pump chamber can be easily carried out to meet with various specifications.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, a description will be given, with reference to the drawings, of a plurality of embodiments according to the invention.

First Embodiment

Figure 1:
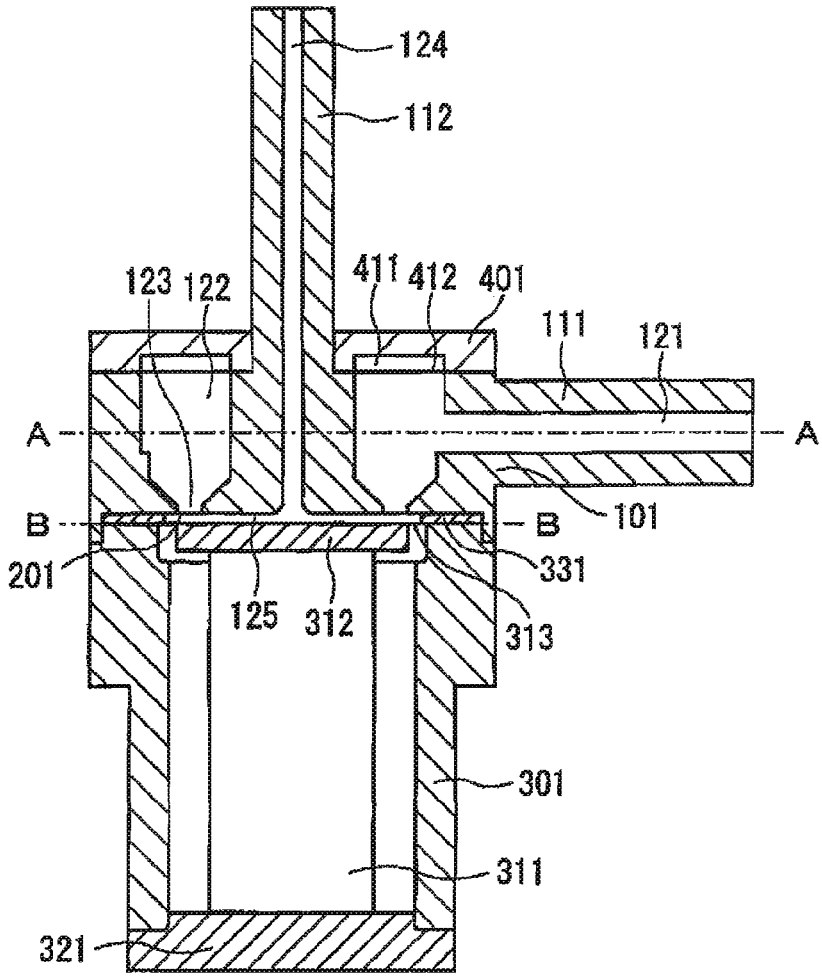
FIG. 1 is a vertical section of a first embodiment of a pump according to an aspect of the invention.
Figure 2:
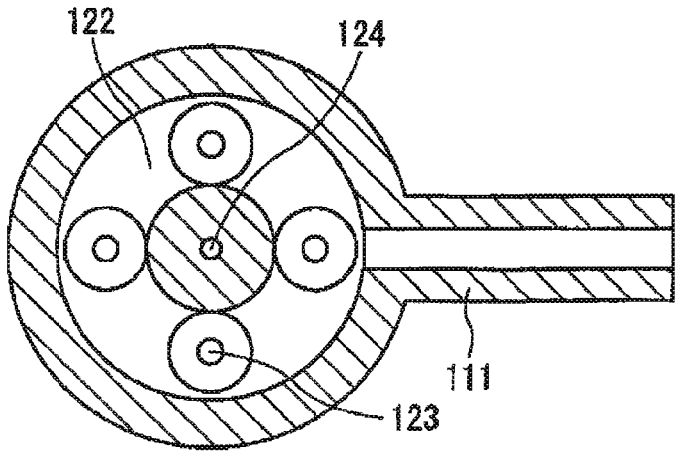
FIG. 2 is a cross-sectional view of the pump in FIG. 1 taken along line A-A as seen from above.

First, a description will be given, with reference to FIG. 1, of a pump configuration according to a first embodiment of the invention. FIG. 1 shows a vertical cross-section of a pump according to the first embodiment of the invention. FIG. 2, being a top view of a film protective cover 401 and an annular resin film 412, attached to the upper surface of the pump shown in FIG. 1, in a state removed from the pump, is a cross-sectional view taken along line A-A in FIG. 1. A bottom plate 321 is secured to the bottom of a cylindrically-configured casing 301, and a laminated type piezoelectric element 311 is secured to the upper surface of the bottom plate 321. A reinforcement plate 312 is secured to the upper surface of the laminated type piezoelectric element 311, while a diaphragm 313 is secured to both the upper surface of the reinforcement plate 312 and a rim of the casing 301.

Above the diaphragm 313, a channel member 101 is affixed, by a not-shown screw, to the casing 301, in such a way as to sandwich an annular member 331 and a valve plate 201. A cylindrically-configured pump chamber 125 is formed by the members wherein the inner periphery of the annular member 331 forms the side wall, the diaphragm 313 is the bottom surface, and the valve plate 201 and the channel member 101 are the upper surface. As the shape of the pump chamber 125 can be changed as desired by the simply-structured annular member 331, it can be changed, easily and at low cost, to suit the characteristics of a working fluid and the required specifications etc. of a pump.

One end of an outlet connection pipe 112 is connected to the channel member 101, wherein a pipeline element 124 is hollowed out of the widthwise center of the outlet connection pipe 112, opening into the pump chamber 125. The widthwise center of the outlet connection pipe 112 corresponds to the rotor-configured, axial center of the pump chamber.

One end of an inlet connection pipe 111 is connected to an annular fluid chamber 122, wherein an inflow channel 121 is hollowed out of the widthwise center of the inlet connection pipe 111, opening into the annular fluid chamber 122. A plurality of valve holes 123 is opened in the bottom of the annular fluid chamber 122, facing towards the pump chamber, wherein an area above the valve holes 123 is tapered in order to reduce a fluid resistance. The other ends of the inlet connection pipe 111 and the outlet connection pipe 112 are each connected to an external fluid system by an appropriate resin tube or the like (not shown).

Figure 3:
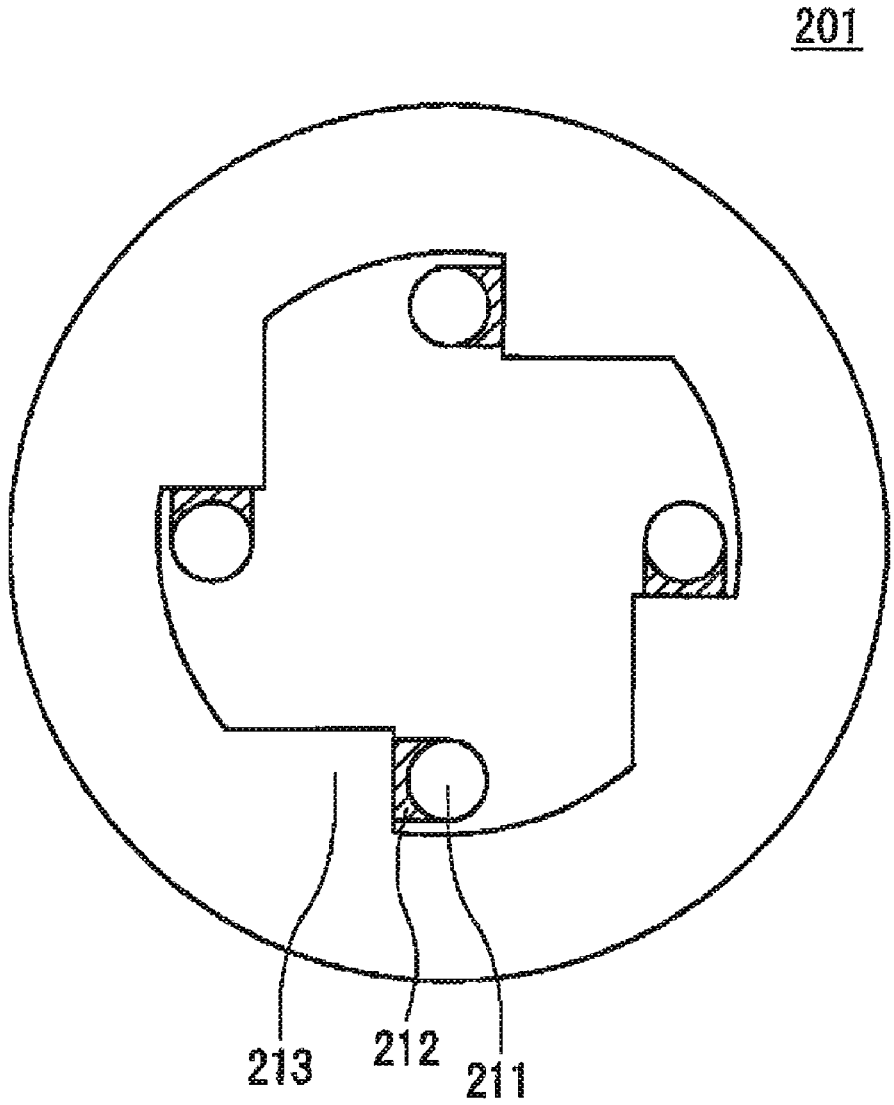
FIG. 3 is a cross-sectional view of a valve plate in the first embodiment of the pump according to the aspect of the invention.
Figure 5A:
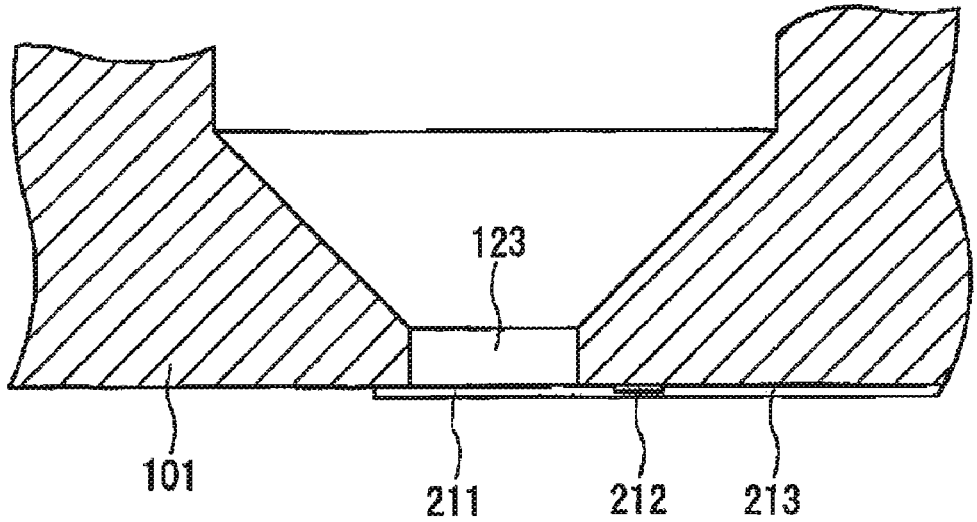
FIGS. 5A and 5B are sectional side views showing a valve operation according to an aspect of the invention.

At this point, a detailed description of a configuration of the valve plate 201 will be given using FIG. 3. As shown in FIG. 3, the configuration of the valve plate 201 is such that a plurality of valve portions 211 is integrally formed in the inner periphery of a valve base 213, which is a single sheet metal, as a fluid resistance element, in such a way as to open in a unidirectional circumferential direction. The valve portions 211 are configured larger than the valve holes 123. Furthermore, as shown in FIG. 5A, a valve bending portion 212 is configured, by etching the sheet metal, between the valve base 213 and the valve member 211.

As the structure is such that a plurality of valves is formed from a single member, as heretofore described, a positioning of the valve members 211 and the valve holes 123 is easy.

Also, a check valve is formed by the valve plate 201 and the valve hole 123. As previously described, as the structure is such that a plurality of valves is formed from a single member, meaning that the positioning of the valve members 211 and the valve holes 123 is easy, a prevention of a reverse flow of the fluid can be reliably carried out.

As the structure is such that a plurality of valves is formed from a single member, as heretofore described, it is possible to manufacture a check valve at a low cost.

Next, a definition of a channel inertance value L will be carried out. In a case in which a cross-sectional area of the channel is S, a length of the channel is 1, and a density of the working fluid is ρ, it is given that $L=\rho\times 1/S$. In a case in which a differential pressure of the channel is ΔP, and a flow volume flowing through the channel is Q, by converting a dynamic equation of the fluid in the channel using the inertance value L, a relationship $\Delta P=L\times dQ/dt$ is obtained.

In short, the inertance value L represents an extent of an effect which a unit pressure exerts on a time change of the flow volume in that the larger the inertance value L, the smaller the time change of the flow volume, and the smaller the inertance value L, the larger the time change of the flow volume.

Also, regarding a synthetic inertance value related to a plurality of channels connected in parallel and a plurality of channels of differing configuration connected in series, it is acceptable that the inertance value of each channel is synthesized and calculated in the same way as an inductance parallel connection and series connection in an electrical circuit. To be specific, the synthetic inertance value in the case of a plurality of channels connected in parallel is synthesized and calculated in the same way as the inductance parallel connection in the electrical circuit. Also, the synthetic inertance value in the case of a plurality of channels of differing configuration connected in series is synthesized and calculated in the same way as the inductance series connection in the electrical circuit.

Next, a definition will be given of an inlet channel and an outlet channel.

In the case of the channel through which the fluid flows into the pump chamber 125, a section of the channel from an opening into the pump chamber 125 to a connection with a pulsation absorber is referred to as the inlet channel. In this case, the pulsation absorber being a section which sufficiently reduces a pressure fluctuation inside the channel, a channel made of a material which is easy to deform according to an internal pressure, such as a rubber like silicon rubber, another resin and a thin metal, and an accumulator connected to the channel, as well as a convergence channel which synthesizes a plurality of pressure fluctuations of differing phases, and the like, correspond to the pulsation absorber.

In this embodiment, as shown in FIG. 1, a buffer chamber 411 configured by the film protective cover 401 is formed as the pulsation absorber in the upper part of the annular fluid chamber 122, wherein the flexible annular resin film 412 seals the annular fluid chamber 122 from the working fluid. As there is a hole, not shown, in the film protective cover 401, the configuration is such that a capacity of the buffer chamber 411 changes freely. As such, the channel from the opening of the valve hole 123 into the pump chamber 125 to the annular resin film 412 is referred to as the inlet channel.

Also, in this embodiment, the buffer chamber is configured to be formed annularly around the outlet channel, with the result that, as well as enabling the formation of the buffer chamber in the vicinity of the inlet side fluid resistance element, so that the synthetic inertance of the inlet channel becomes smaller, there is a benefit of being able to equalize the inertance as far as the plurality of valve holes.

The definition of the outlet channel is similar to that of the inlet channel in that, in the case of the channel through which the fluid flows from the pump chamber 125, as a flexible resin tube, not shown, is connected to the outlet connection pipe 112, a section from an opening of the pipeline element 124 into the pump chamber 125 to the end face of the outlet connection pipe 112 is the outlet channel. That is, in this embodiment, the pipeline element 124 itself is referred to as the outlet channel.

Figure 4:
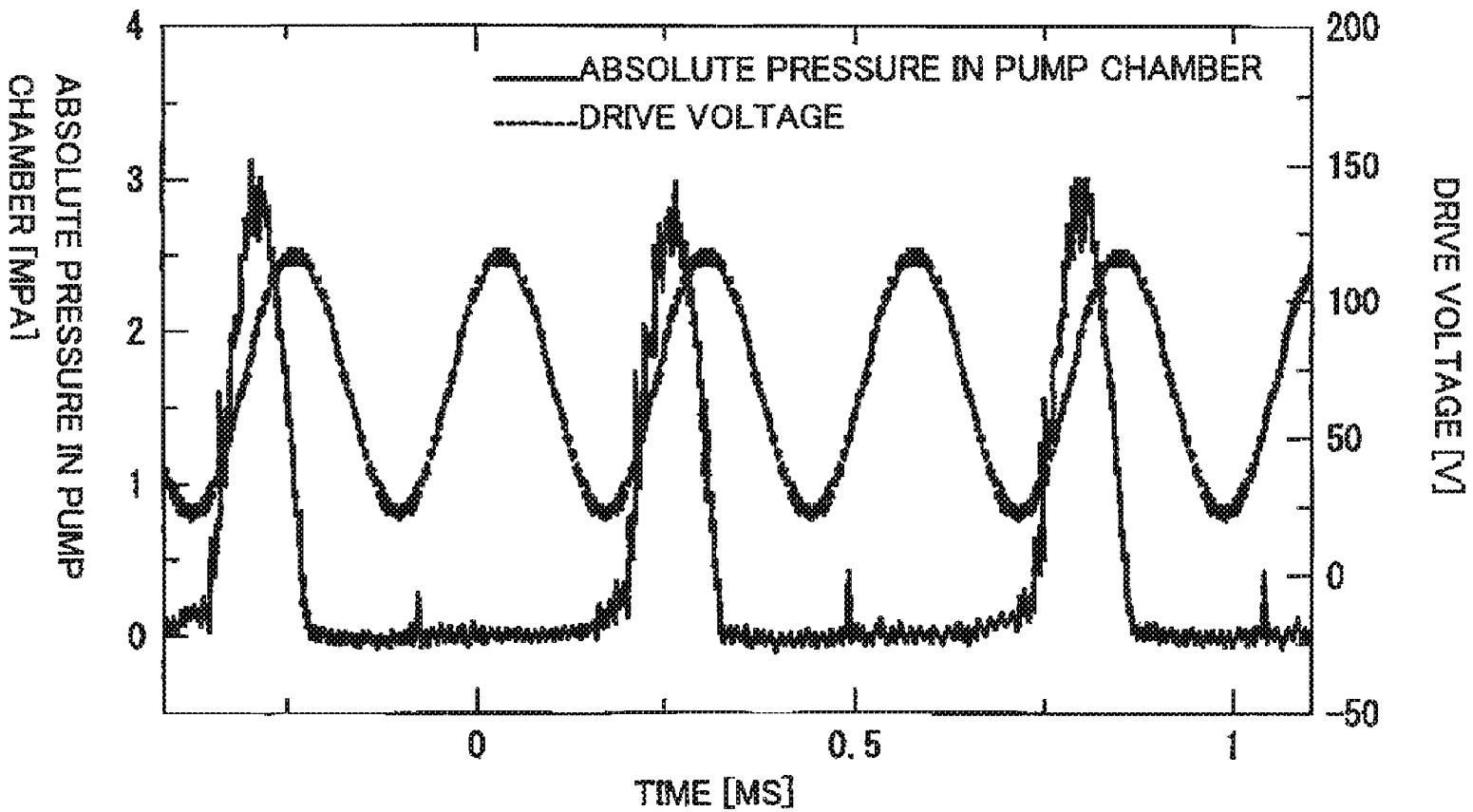
FIG. 4 is a graph showing a drive voltage of a laminated type piezoelectric element, and an absolute pressure display pressure waveform inside a pump chamber, of the pump according to the aspect of the invention.

Next, a description will be given, using FIG. 4, of a pump operation of the configuration shown in FIG. 1. FIG. 4 is a graph showing a drive voltage to the laminated type piezoelectric element 311 and an absolute pressure display pressure waveform inside the pump chamber 125. As the working fluid is water, a load pressure (=the pressure of the working fluid downstream of the pump chamber 125) of approximately three atmospheres is added to the pump.

As the laminated type piezoelectric element 311 extends in an upward direction in FIG. 1 when the drive voltage increases, the diaphragm 313 compresses the volume of the pump chamber 125. After a trough of the drive voltage, the compression of the pump chamber 125 causes a pressure rise to start then, after a point is passed at which the drive voltage rise gradient is at its highest, the internal pressure of the pump chamber 125 drops steeply. When the absolute pressure inside the pump chamber nears zero atmospheres, components dissolved in the working fluid gasify, aeration and cavitation, resulting in air bubbles, take place, and the internal pressure of the pump chamber 125 evens out when the absolute pressure inside the pump chamber is in the vicinity of zero atmospheres.

At this point, a description will be given of a flat portion of the internal pressure of a main pump chamber in FIG. 4. First, in a condition in which the valve hole 123 is closed by the valve member 211, the large inertance of the outlet channel when the pump chamber 125 is compressed causes the pressure inside the pump chamber 125 to rise considerably. The working fluid in the outlet channel is accelerated by the rise in pressure, and kinetic energy, which generates an inertia effect, is built up.

When the laminated type piezoelectric element 311 expansion and contraction speed gradient becomes small, as the working fluid tends to continue to flow due to the inertia effect created by the kinetic energy built up in the working fluid inside the outlet channel up to that point, the pressure inside the pump chamber 125 drops steeply, presently becoming lower than the pressure inside the inlet channel. At this point, the pressure difference causes the valve member 211 to open, and the working fluid flows from the inlet channel into the plump chamber 125.

At this time, as the synthesized inertance value of the inlet channel is smaller than the synthesized inertance value of the outlet channel, an increase rate of the inflow volume in the inlet channel is large. For this reason, at the same time as an outflow from the outlet channel is continuing, a large amount of the working fluid flows into the pump chamber 125. Then, the condition in which the outflow from and the inflow into the pump chamber 125 occur simultaneously continues until the laminated type piezoelectric element 311 contracts, then reverts to extending again.

In short, a condition exists in the pump of this structure whereby discharge and suction occur simultaneously and, as this condition is in effect for approximately two-thirds or more of the operating time of the pump, it is possible to flow a large flow volume.

Incidentally, although the extremely high pressure inside the pump chamber enables a handling of a high load pressure, in the event that the synthesized inertance value of the inlet channel is made larger than the synthesized inertance value of the outlet channel, the inflow volume to the pump chamber 125 decreases and counter flow occurs in the outlet channel, resulting in a reduction of pump discharge flow volume and a drop in performance.

Also, as FIG. 4 shows that the pressure inside the pump chamber 125 rises to a maximum absolute pressure of approximately three MPa, the pump of this structure causes a high pressure to occur inside the pump chamber, thereby obtaining a high output. As a result, particularly in a case in which air bubbles accumulate inside the pump chamber 125, an amount of change in the pump chamber volume (hereafter called an elimination volume), which occurs due to the deformation of the diaphragm 313 in the time between the most contracted condition and the most extended condition of the laminated type piezoelectric element 311, is used to compress the air bubbles, whereby it stops contributing to the pressure rise in the pump chamber, and the pump operation becomes impossible. This means that it is important that the accumulated air bubbles are swiftly eliminated.

Figure 5B:
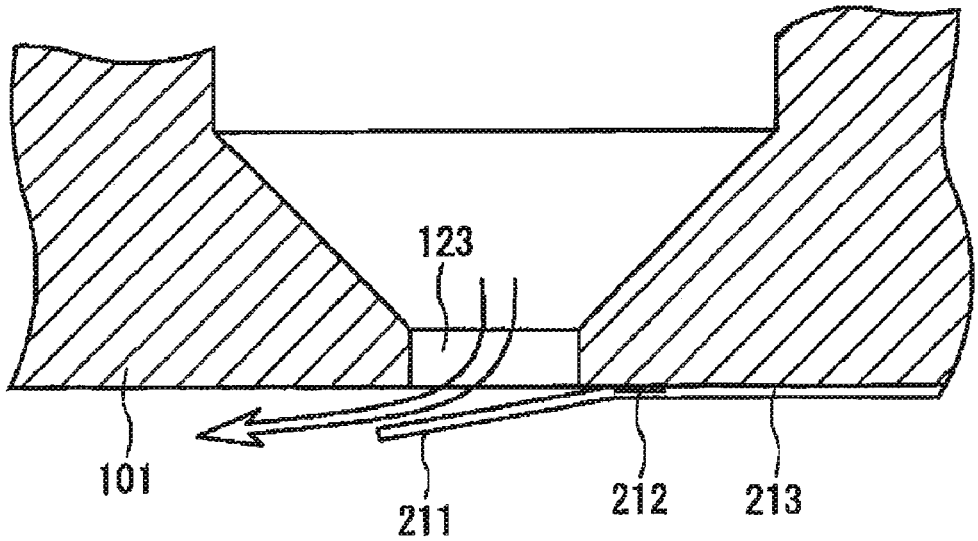
Figure 6:
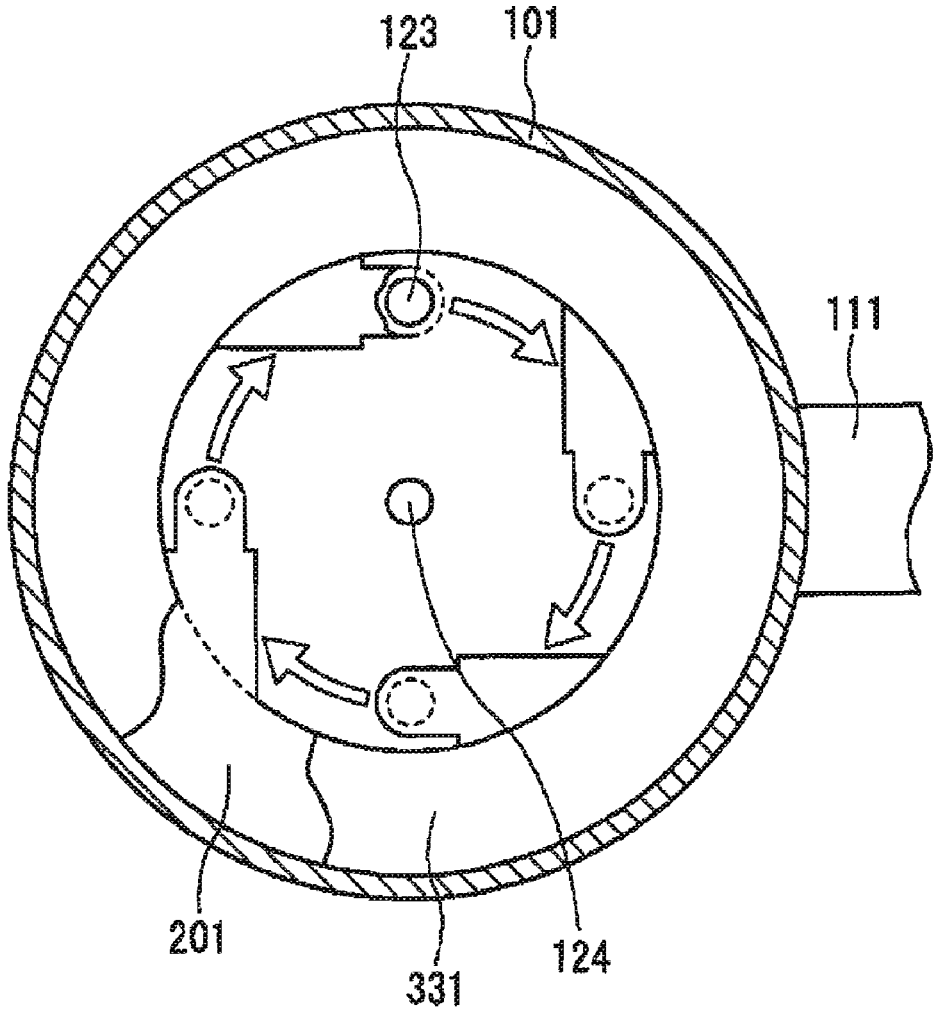
FIG. 6 is a cross-sectional view of the pump in FIG. 1 taken along line B-B, showing a flow of a fluid when flowing into the pump chamber 125 as seen from below.

At this point, a description will be given, using FIGS. 5A, 5B and 6, of the elimination of the air bubbles in the pump of this embodiment. FIGS. 5A and 5B are sectional side views showing a valve operation, while FIG. 6 is a cross-sectional view of the pump, taken along line B-B, showing the flow of the fluid when it flows into the pump chamber 125 as seen from below. FIG. 5A shows the valve in a closed condition, while 5B shows the valve in an open condition. The arrow in FIG. 5B indicates the flow of the working fluid, In the event that the pressure on the pump chamber 125 side is higher than that on the valve hole 123 side, the valve portion 211 is closely attached to the underneath of the channel member 101 by the difference in pressure, as shown in FIG. 5A. As such, the valve hole 123, which is smaller than the valve portion 211, is closed by the valve portion 211, whereby the backflow of the working fluid is prevented.

Contrarily, in the event that the pressure on the pump chamber 125 side is lower than that on the valve hole 123 side, the valve portion 211 is pressed downwards by the difference in pressure. As such, the check valve is released, as shown in FIG. 5B. At this time, as the etched valve bending portion 212 has a greater curvature than the valve base 213 and the valve portion 211, the valve member 211 becomes inclined with respect to the valve hole 123, as shown in FIG. 5B. By means of the inclined valve portion 211, the working fluid which flows in from the valve hole 123 flows along the channel member 101, as shown in FIG. 6. That is, it is one example of a rotational flow generation structure.

To describe the flow of the working fluid with reference to FIG. 6, the working fluid, whose direction is changed to a unidirectional circumferential direction of the pump chamber 125 by the valve portion 211, becomes a rotational flow along the approximate rotor-configured pump chamber 125. Due to the effect of the centrifugal force of the rotational flow, the air bubbles in the working fluid are collected in the center, and discharged through the pipeline element 124 which opens into the pump chamber 125.

In the pump according to an aspect of the invention, the rotational flow is accelerated when the working flow is sucked into the pump chamber. As heretofore described, as the suction time occupies two-thirds or more of the pump operating time, it is possible to generate a high-speed rotational flow, thereby obtaining a high air bubble elimination effect from the large centrifugal force.

Also, in the pump according to an aspect of the invention, it is also acceptable to regulate the flow of the working fluid so that a stronger rotational flow is generated. A description will be given, using FIGS. 7A and 7B, of a configuration which regulates the flow of the working fluid in this way.

Figure 7A:
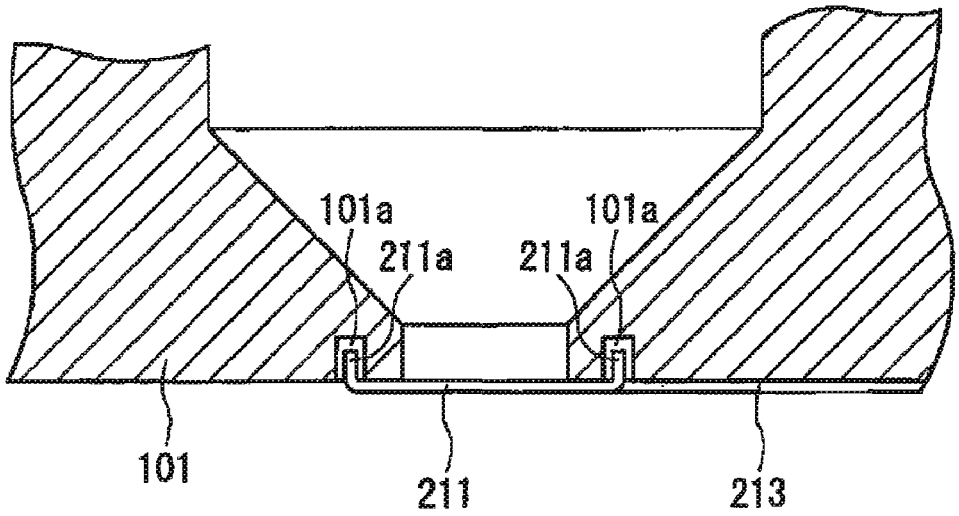
FIGS. 7A and 7B are cross-sectional views showing a modified example of the first embodiment of the pump according to the aspect of the invention.
Figure 7B:
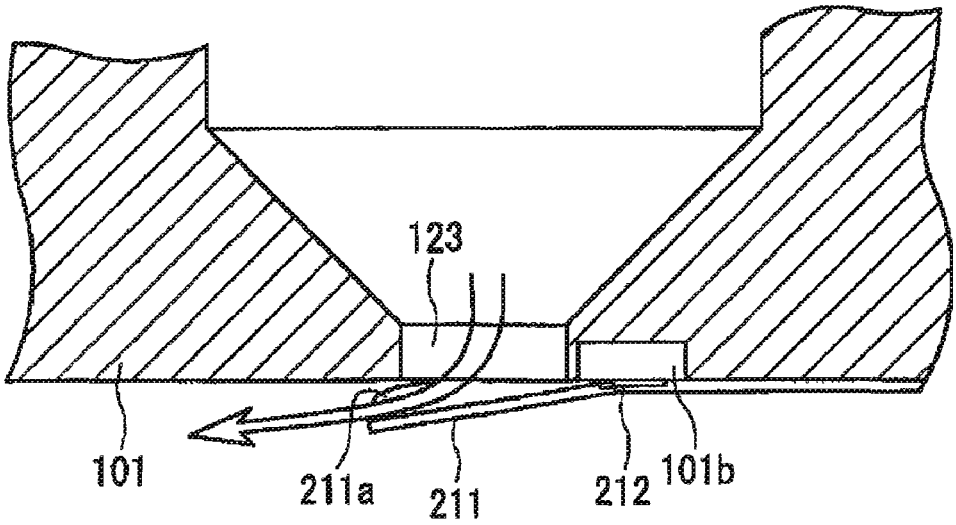

As in FIGS. 5A and 5B, FIG. 7A shows the valve in a closed condition, while FIG. 7B shows the valve in an open condition. FIG. 7A is a cross-sectional view taken along the plane which is perpendicular to that of FIG. 5A. As shown in these figures, sides 211*a* of the valve member 211, which follow the flow of the working fluid, are bent at a right-angle by pressing or the like. As the sides 211*a* are formed to follow the flow of the working fluid, when the valve is in an open condition, as shown in FIG. 7B, it can regulate the flow in a rotational flow direction more forcibly than a valve which is not bent. As a result, it is possible to form a stronger flow in a unidirectional circumferential direction of the pump chamber 125, thereby enabling the generation of a stronger rotational flow. Via the generation of this kind of stronger rotational flow, it is possible to obtain a higher air bubble removal effect.

As shown in FIG. 7A, storage grooves 101*a*, having a depth equal to or greater than the height of the sides 211*a*, are formed in the pump chamber 125 side of the channel member 101, so as to enable a storage of the sides 211*a* of the valve member 211. As a result, as shown in FIG. 7A, when the valve is in a closed condition, it is possible to securely close the valve hole 123 by means of the valve portion 211, with no danger of the closing of the valve portion 211 being impeded by the sides 211*a*.

Also, as shown in FIG. 7B, at the same time as forming the storage grooves 101*a*, it is also acceptable to form a groove 101*b* in one part of the channel member 101 which comes in contact with the valve bending portion 212. By the formation of this kind of groove 101*b*, even in the event that a foreign object comes in between the valve bending portion 212 and the channel member 101, the foreign object is taken into the groove 101*b*, meaning that there is no danger of it impeding the movement of the valve bending portion 212.

A configuration which regulates the flow of the working fluid is not limited to the configurations shown in FIGS. 7A and 7B, as it is also acceptable, for example, to provide a wall which regulates the flow of the working fluid in the channel member 101 side.

Second Embodiment

Next, a description will be given of a second embodiment.

As a structure of a pump according to the second embodiment (refer to FIG. 1) has many parts in common with the structure of the pump in the first embodiment, the common parts are given like reference numerals etc., the descriptions are omitted, and the description hereafter focuses on the differences.

In the structure of the pump, a rotational flow generation structure and a structure of a check valve, which acts as a fluid resistance element, are different.

Figure 8A:
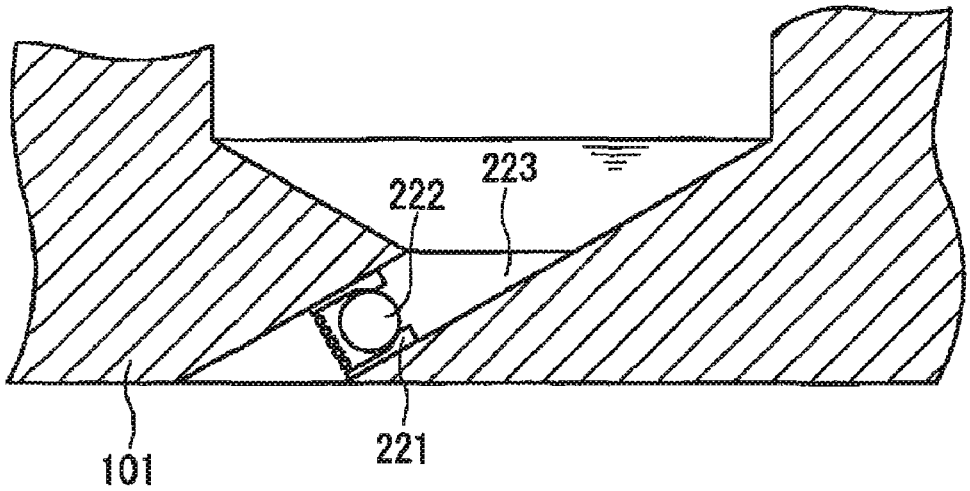
FIGS. 8A and 8B are sectional side view of a second embodiment of the pump according to the aspect of the invention.
Figure 8B:
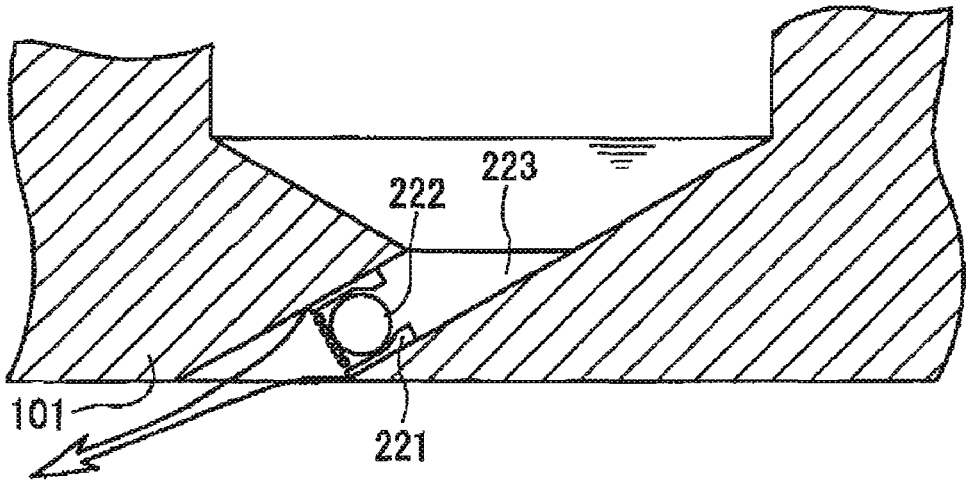

FIGS. 8A and 8B are sectional side views showing a valve operation. As in the first embodiment, a pump chamber is formed in the bottom of the channel member 101. An inclined channel 223 is hollowed out so as to be inclined with respect to the bottom surface of the channel member 101, wherein a check valve unit, comprising a valve seat 221 and a ball 222, is press fitted inside the inclined channel 223.

The valve seat 221 is structured to have a hole which is smaller than the ball 222 on the upstream side of the channel (the valve hole 123 side), and a lattice-formed plate, to prevent the ball 222 from dropping out, on the downstream side of the channel (the pump chamber 125 side).

As shown in FIG. 8A, when the ball 222 moves to the upstream side, the channel is closed and the fluid resistance increases. Consequently, as shown in FIG. 8B, the channel is not closed when the ball 222 moves to the downstream side.

In FIG. 8B, in the event that the upstream side pressure of the working fluid is greater than that of the downstream side, the ball 222 moves to the downstream side, and the working fluid is ejected diagonally with respect to the pump chamber from the inclined channel 223, as shown by the arrow in the figure. As a result, in the same way as in the first embodiment, it is possible to generate a rotational flow in the pump chamber, thus enabling the elimination of the air bubbles by centrifugal force.

That is, in this embodiment, the rotational flow generation structure is inclined with respect to the pump chamber of the inclined channel 223. As a result, although the number of parts increases in comparison with the first embodiment, as the fluid resistance element and the rotational flow generation structure are independent there is an advantage of being able to give each of them an optimum structure.

Also, although in this embodiment the inner diameter of the inclined channel 223 is fixed, it is possible to generate a stronger rotational flow by decreasing the inner diameter on the charnel downstream side (the pump chamber 125 side), thereby increasing the ejection speed of the working fluid into the pump chamber 125.

Furthermore, it is possible to generate the rotational flow more effectively by bending the inclined channel 223 part way along, thereby increasing the angle of inclination with respect to the pump chamber 125.

Figure 9:
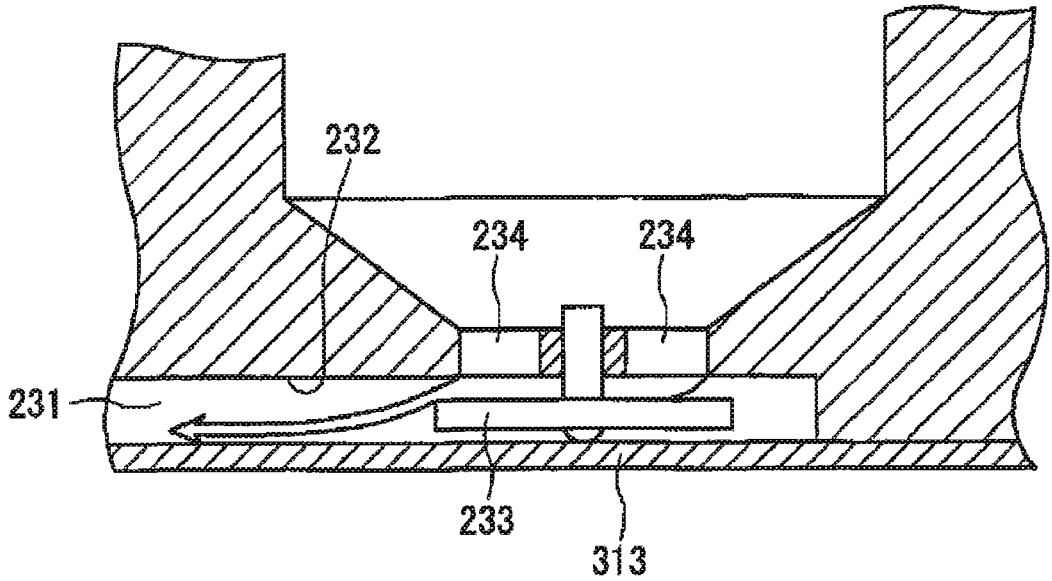
FIG. 9 is a cross-sectional view showing a modified example of the second embodiment of the pump according to the aspect of the invention.

Contrarily, as shown in FIG. 9, it is also acceptable to provide a horizontal channel (a horizontal channel 231) instead of the inclined channel 223. This kind of horizontal channel 231 forms a notch 232 in the channel member 101, whereby it can be configured by the notch 232 and the diaphragm 313.

Even in the case of this kind of horizontal channel 231, as it is connected facing in the circumferential direction of the pump chamber 125, thereby enabling the working fluid to flow in the circumferential direction of the pump chamber 125, it is possible to generate the rotational flow.

Also, as it is possible in this way to generate the rotational flow by the horizontal channel 231 alone, there is no restriction on a form of a check valve, increasing the options for selecting the check valve. For this reason, for example, as shown in FIG. 9, it is also possible to use a float valve 233. In the event of using the float valve 233, by making a valve hole 234 a plurality of long apertures rather than a round aperture, it is possible to increase the flow volume of the working fluid caused to flow into the pump chamber 125. By this means, it is possible to easily generate a stronger rotational flow.

Figure 10:
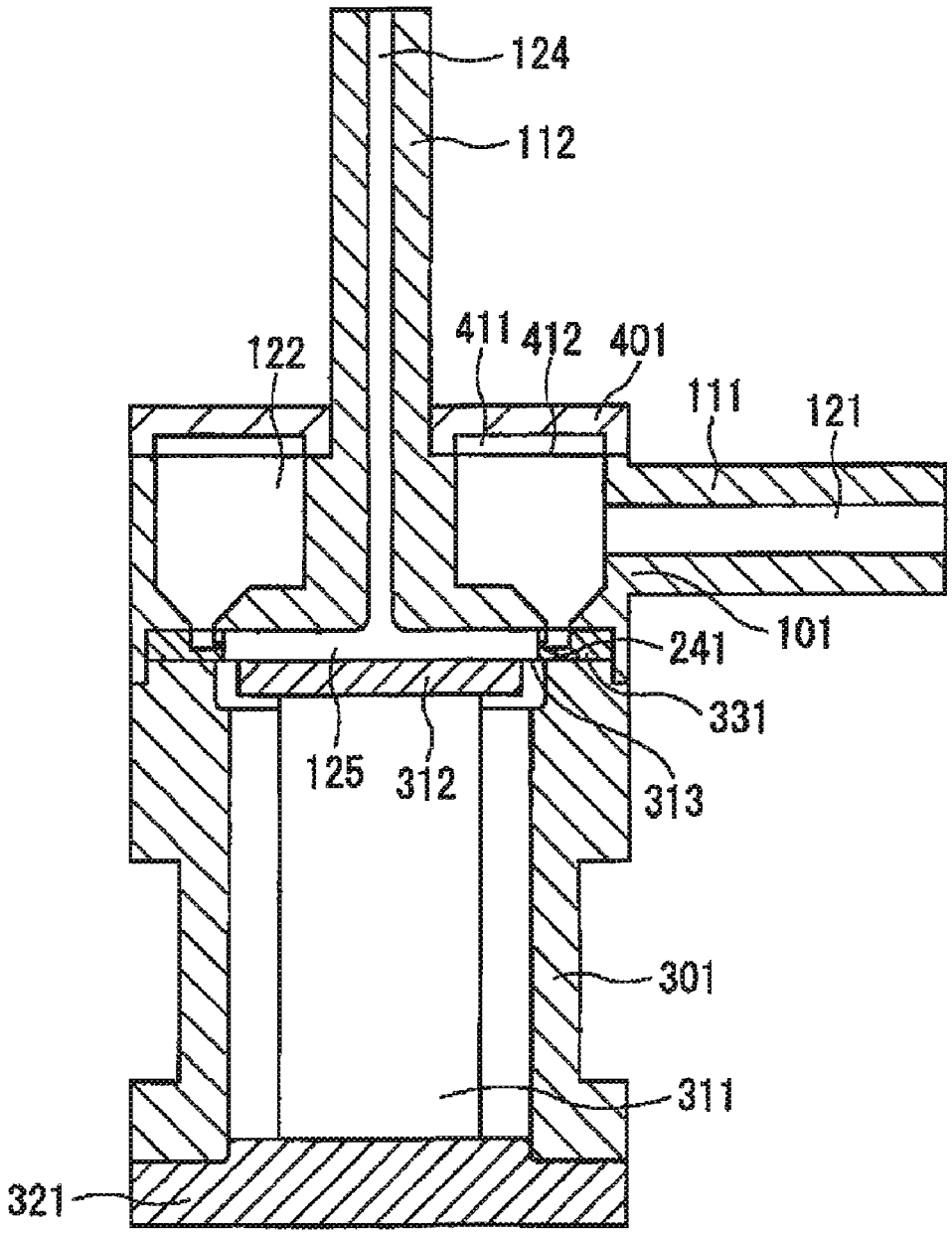
FIG. 10 is a cross-sectional view showing a modified example of the second embodiment of the pump according to the aspect of the invention.

Also, as shown in FIG. 10, it is also acceptable to build a horizontal channel 241 into the annular member 331, connecting the horizontal channel 241 to the side wall of the pump chamber 125. In this way, by connecting the horizontal channel 241 to the side wall of the pump chamber 125, it is possible to generate a fast-flowing rotational flow in the vicinity of the side wall of the pump chamber 125, where the air bubbles are most likely to accumulate, thereby enabling a more reliable elimination of the air bubbles.

Figure 11:
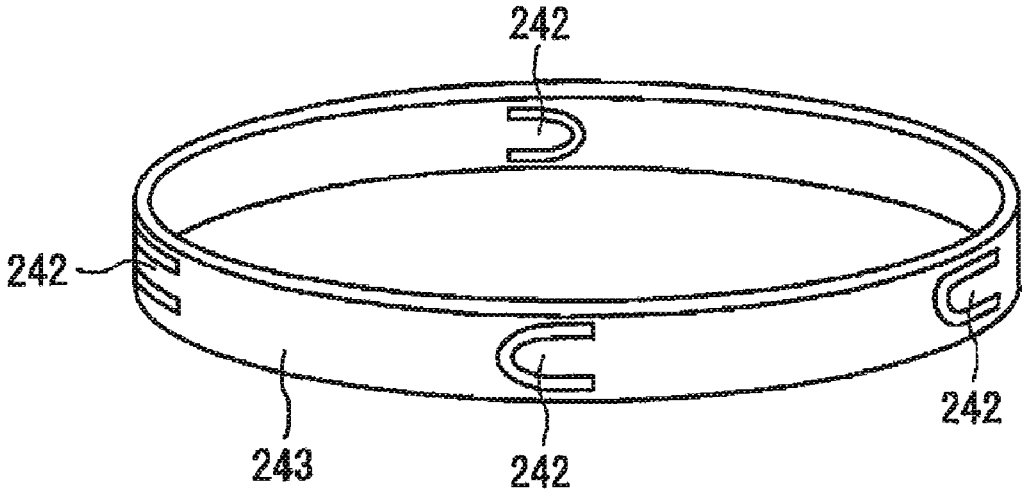
FIG. 11 is a perspective view showing a plate material provided to the modified example of the second embodiment of the pump according to the aspect of the invention.

In the case in which the horizontal channel is connected to the side wall of the pump chamber 125, although it is acceptable to cause the horizontal channel to incline with respect to the side wall and provide a check valve inside the horizontal channel, in the same way as in FIG. 9, it is also acceptable to install a check valve by fitting a ring-like plate material 243, in which check valves 242 are formed in positions in which they make contact with connection points of the horizontal channel, into the annular member 331, as shown in FIG. 11. In this case, even though the horizontal channel is perpendicular to the side wall of the pump chamber, the rotational flow is generated by an operation of the check valve.

Third Embodiment

Next, a description will be given of a third embodiment.

As a structure of a pump according to the third embodiment (refer to FIG. 1) also has many parts in common with the configuration of the pump in the first embodiment, the common parts are given like reference numerals etc., the descriptions are omitted, and the description hereafter focuses on the differences.

The pump according to the third embodiment differs from the pump according to the first embodiment in that a forced flow portion (a flow speed increase section) is provided which accelerates a flow speed of the working fluid in the pump chamber 125.

Figure 12:
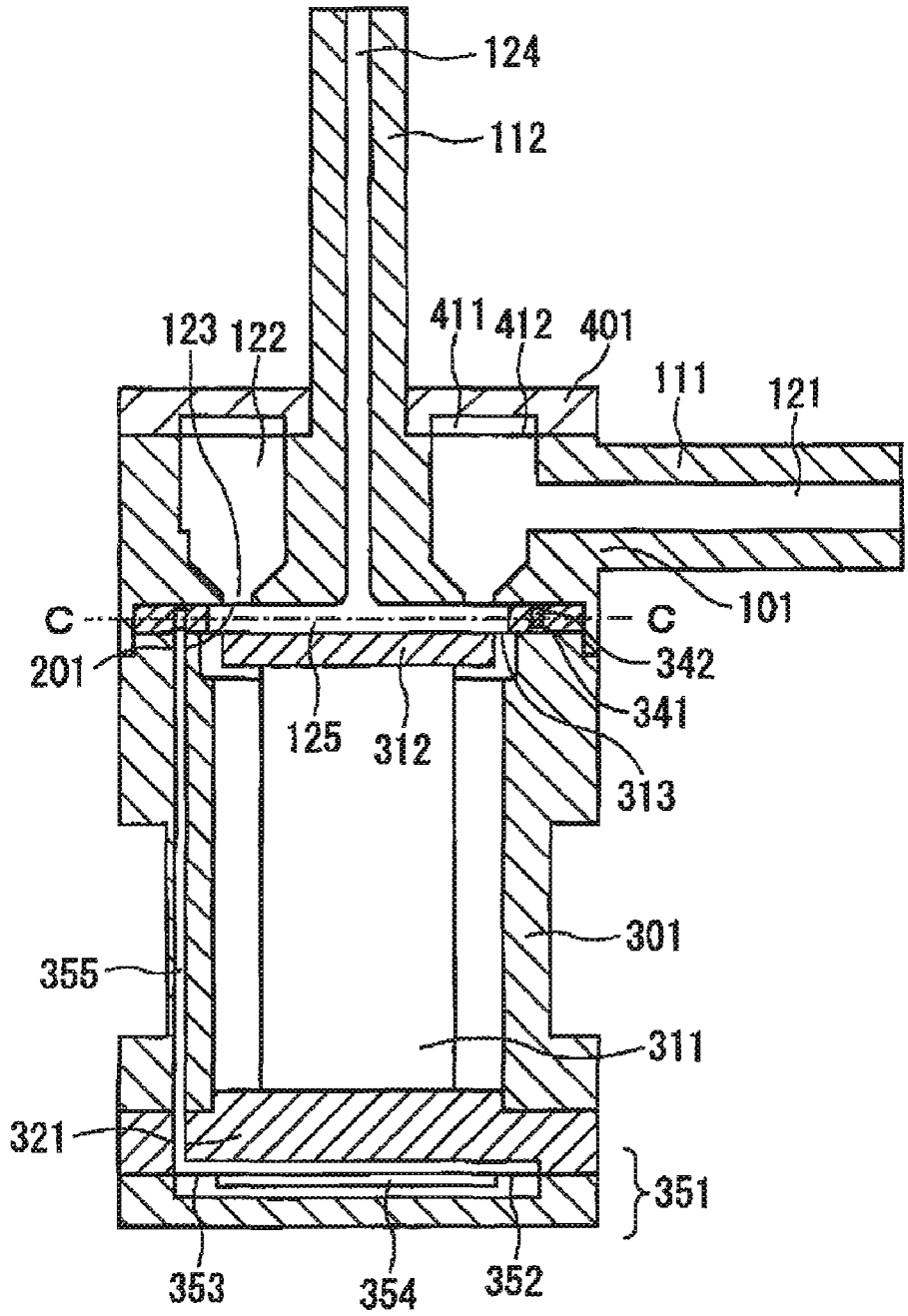
FIG. 12 is a sectional side view of a third embodiment of the pump according to the aspect of the invention.

FIG. 12 shows a vertical section of the pump according to the third embodiment. Also, FIG. 13 is a cross-sectional view taken along line C-C in FIG. 12.

Figure 13:
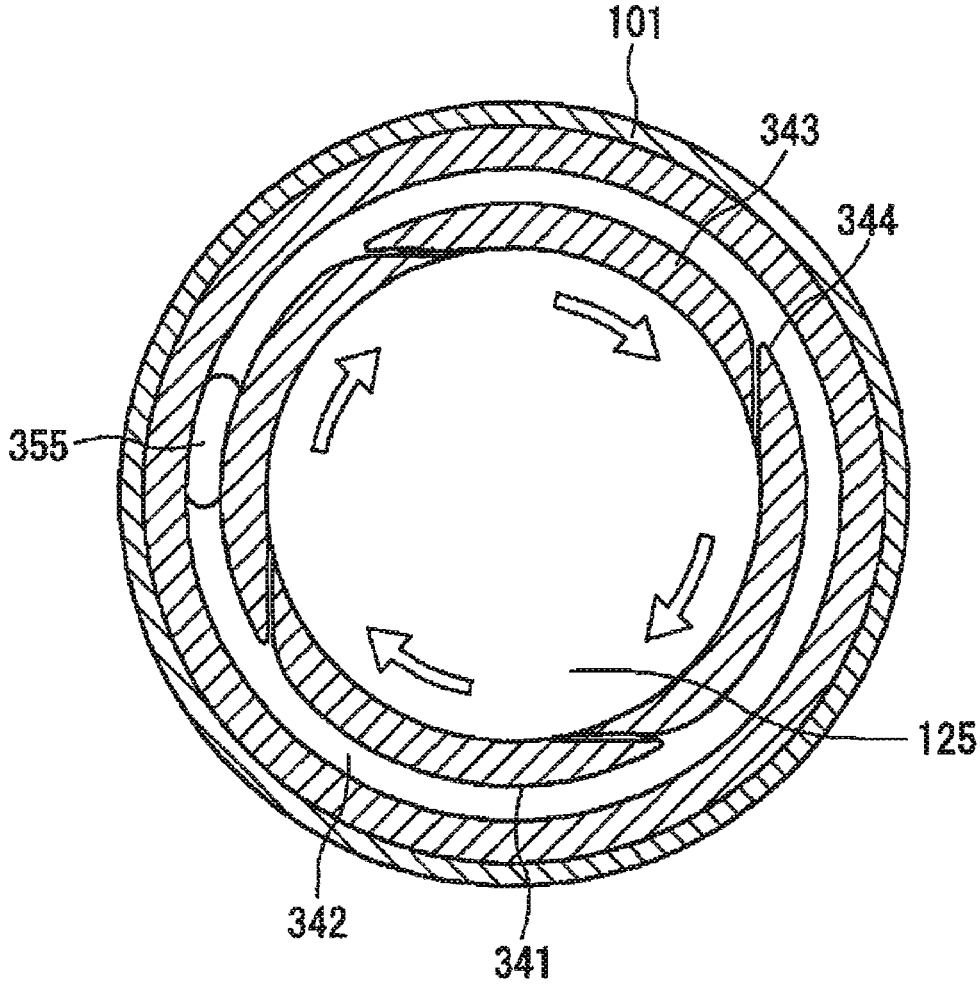
FIG. 13 is a cross-sectional view of the pump in FIG. 12 taken along line C-C as seen from above.

As shown in FIG. 13, the pump according to the third embodiment is equipped with an annular member 341, which has an outer chamber 342 surrounding the pump chamber 125, instead of the annular member 331 with which the pump according to the first embodiment is equipped. An intermediate wall 343 is formed between the pump chamber 125 and the outer chamber 342. A plurality of channels 344 is formed in the intermediate wall 343 facing in one circumferential direction of the pump chamber 125.

As shown in FIG. 12, a forced flow portion 351, which is equipped with a second pump chamber 352, is disposed lower again than the bottom plate 321. A diaphragm 353, and a piezoelectric element 354 which drives the diaphragm 353, are stored inside the pump chamber 352. A not-shown wiring is connected to the piezoelectric element 354, through which wiring a current is applied to the piezoelectric element 354.

Then, the second pump chamber 352 of this kind of forced flow portion 351 and the outer chamber 342 are connected via a connection channel 355 which is formed through the casing 301 and the bottom plate 321.

in accordance with the pump according to the third embodiment having this kind of configuration, the current is applied to the piezoelectric element 354, whereby the diaphragm 353 is moved back and forth. Then, the working fluid in the second pump chamber 352 is caused to flow by the back and forth movement of the diaphragm 353.

More specifically, when the diaphragm 353 moves toward the lower portion of the plane of FIG. 12, the working fluid flows into the second pump chamber 352, while when the diaphragm 353 moves toward the upper portion of the plane of FIG. 12, the working fluid is discharged from the second pump chamber 352. Then, when the working fluid flows into the second pump chamber 352, the working fluid in the pump chamber 125 is discharged into the outer chamber 342 via the channels 344 formed in the intermediate wall 343. Also, when the working fluid flows from the second pump chamber 352, the working fluid flows into the pump chamber 125 via the channels 344 formed in the intermediate wall 343.

That is, in the pump according to the third embodiment, the working fluid enters and leaves the pump chamber 125, via the channels 344 formed in the intermediate wall 343, by means of the diaphragm 353 of the forced flow member 351 being driven.

When the fluid is discharged, a strong fluid flow is formed in the environment into which the fluid is discharged, while when the fluid is sucked in, it is difficult for the fluid flow to form in the environment into which the fluid is sucked. In short, when the working fluid flows into the pump chamber 125, a flow which strengthens the rotational flow inside the pump chamber 125 is formed by the working fluid flowing through the channels 344. However, when the working fluid is discharged from the pump chamber 125, the working fluid is discharged without causing a large effect on the rotational flow inside the pump chamber 125.

Consequently, by repeatedly driving the diaphragm 353 of the forced flow portion 351, it is possible to accelerate the rotational flow of the working fluid inside the pump chamber 125. Then, by the rotational flow of the working fluid being accelerated in this way, the air bubbles in the pump chamber 125 are more easily collected in the center of the pump chamber 125. As such, it is possible to expel the air bubbles more reliably.

In the pump according to the third embodiment, as the forced flow portion 351 is a separate entity, there is no restriction on a capacity of the second pump chamber 352. For this reason, it is easy to secure a sufficient amount of displacement for the diaphragm 353. As a result, it is possible to cause a greater volume of the working fluid to flow, thereby enabling the generation of a stronger rotational flow in the pump chamber 125.

Also, in the pump according to the third embodiment, an increase in size of the pump in a lateral direction is prevented by disposing the forced flow portion 351 below the bottom plate 321. However, in a case in which a size of the pump is not restricted, it is not absolutely necessary to dispose the forced flow portion 351 below the bottom plate 321.

Also, for example, a configuration, whereby the piezoelectric element 354 is driven while the laminated type piezoelectric element 311 is stopped, can double as a laminated type piezoelectric element 311 drive circuit and a piezoelectric element 354 drive circuit.

As another example of the configuration heretofore described, it is acceptable to provide the tilted channels 223 in the approximately rotor-configured peripheral wall. For example, it is also possible to form a spiral groove in the annular member, and cause the working fluid to flow into the pump chamber 125 through the groove.

Also, as a rotational flow generation structure, it is also acceptable to use one whereby a spiral groove is provided in at least a one-side wall which intersects with a rotational axis of the approximately rotor-configured pump chamber 125.

Also, in the aforementioned embodiments, a description has been given of a pump in which the synthetic inertance value of the inlet channel is smaller than the synthetic inertance value of the outlet channel. However, the invention is not limited to this configuration, as it can also be applied to a pump in which the synthetic inertance value of the inlet channel is larger than the synthetic inertance value of the outlet channel, and the outlet channel is also equipped with a fluid resistance element.

The invention can be used in any industry which uses compact, high-output pumps.

The entire disclosure of Japanese Patent Application Nos: 2005-116566, filed Apr. 14, 2005 and 2006-062734, filed Mar. 8, 2006 are expressly incorporated by reference herein.

What is claimed is:

1. A pump comprising:

a pump chamber for which a capacity is changeable;

an inlet channel which allows a working fluid to flow into the pump chamber;

an inlet side fluid resistance element disposed between the pump chamber and the inlet channel;

an outlet channel which allows the working fluid to flow out of the pump chamber;

a pipeline element formed inside the outlet channel; and a rotational flow generation structure, which generates a rotational flow of the working fluid, being provided in the pump chamber, the outlet channel being located adjacent to the rotational center of the rotational flow, and the inlet channel and the outlet channel being configured to allow the working fluid to flow into the pump chamber and out of the pump chamber simultaneously.

2. The pump according to claim 1, a synthetic inertance value of the inlet channel being smaller than a synthetic inertance value of the outlet channel.

3. The pump according to claim 1, the rotational flow generation structure being the inlet side fluid resistance element.

4. The pump according to claim 3, including a plurality of the inlet side fluid resistance elements.

5. The pump according to claim 3, the pump chamber having an approximately rotor configuration, the inlet side fluid resistance element being a check valve, which opens onto one circumferential direction of the approximately rotor configuration of the pump chamber.

6. The pump according to claim 5, the plurality of check valves being formed from a single member.

7. The pump according to claim 5, a flow restriction section, which restricts a flow direction of the working fluid, being provided in the check valve or in a part of the pump chamber with which the check valve is in contact.

8. The pump according to claim 7, the flow restriction section being a bent portion formed in the check valve, and a storage groove, which stores the bent portion, being formed in a part of the pump chamber with which the check valve is in contact.

9. The pump according to claim 1, the pump chamber having an approximately rotor configuration, the rotational flow generation structure being a channel facing in the circumferential direction of the approximately rotor configuration of the pump chamber.

10. The pump according to claim 9, the channel being inclined.

11. The pump according to claim 9, further comprising a plurality of the channels.

12. The pump according to claim 9, the channels being located so as to be connected to a side wall of the pump chamber.

13. The pump according to claim 1, further comprising a flow speed increase section which accelerates a flow speed of the working fluid inside the pump chamber.

14. The pump according to claim 1, a period during which the operating liquid being taken into the pump is two-thirds or more of the operating period of the pump.

15. The pump according to claim 1, the pump chamber being circular.

16. A pump comprising:

a pump chamber for which a capacity is changeable;

an inlet channel which allows a working fluid to flow into the pump chamber;

an inlet side fluid resistance element disposed between the pump chamber and the inlet channel;

an outlet channel which allows the working fluid to flow out of the pump chamber;

a pipeline element formed inside the outlet channel, a synthetic inertance value of the inlet channel being smaller than a synthetic inertance value of the outlet channel; and a buffer chamber, which reduces the inertance of a fluid, being formed such that the buffer chamber surrounds the outlet channel, the inlet channel and the outlet channel being configured to allow the working fluid to flow into the pump chamber and out of the pump chamber simultaneously.

17. A pump comprising:

an approximately rotor-configured pump chamber for which a capacity is changeable;

an inlet channel which allows a working fluid to flow into the pump chamber;

an inlet side fluid resistance element disposed between the pump chamber and the inlet channel;

an outlet channel which allows the working fluid to flow out of the pump chamber; and a pipeline element formed inside the outlet channel, a synthetic inertance value of the inlet channel being smaller than a synthetic inertance value of the outlet channel, the side wall of the pump chamber being formed of an annular member, the inlet channel and the outlet channel being configured to allow the working fluid to flow into the pump chamber and out of the pump chamber simultaneously.

* * * * *

UNITED STATES PATENT AND TRADEMARK OFFICE

CERTIFICATE OF CORRECTION

PATENT NO. : 7,600,987 B2
APPLICATION NO. : 11/279844
DATED : October 13, 2009
INVENTOR(S) : Seto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 515 days.

Signed and Sealed this

Fifth Day of October, 2010

David J. Kappos

David J. Kappos
*Director of the United States Patent and Trademark Office*